US006208822B1

(12) United States Patent
Kitoba et al.

(10) Patent No.: US 6,208,822 B1
(45) Date of Patent: Mar. 27, 2001

(54) LIQUID MATERIAL SUPPLIER AND IMAGE FORMING APPARATUS COMPRISING THE SAME

(75) Inventors: Utako Kitoba, Kyoto; Katsuhiko Takeda, Toyonaka; Kosuke Sasai, Kobe, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/517,516

(22) Filed: Mar. 2, 2000

(30) Foreign Application Priority Data

Mar. 3, 1999 (JP) ..... 11-055297
Apr. 13, 1999 (JP) ..... 11-105139

(51) Int. Cl.[7] ..... G03G 15/10; B41J 2/175

(52) U.S. Cl. ..... 399/237; 399/238; 399/57; 347/84

(58) Field of Search ..... 399/57, 237, 238, 399/239; 347/84; 430/117–119

(56) References Cited

U.S. PATENT DOCUMENTS 6,038,421 * 3/2000 Yoshino et al. ..... 399/239

FOREIGN PATENT DOCUMENTS 0 117 670 9/1984 (EP) .
6-72003 3/1994 (JP) .
7-164624 6/1995 (JP) .
10-301398 11/1998 (JP) .

* cited by examiner

*Primary Examiner*—Richard Moses
(74) *Attorney, Agent, or Firm*—McDermott, Will & Emery

(57) ABSTRACT

A liquid material supplier capable of effectively preventing a liquid material, such as ink, held on a surface of a liquid material holding member from drying and an image forming apparatus provided with the same. The supplier includes a liquid material holding member for holding a liquid material on a surface thereof. The liquid material holding member is rotatable in a predetermined direction and supplying, during rotation, the liquid material to a member to be supplied at a given supply position. The supplier further includes a supply station for supplying the liquid material to the surface of the liquid material holding member and a regulating member for regulating the liquid material on the liquid material holding member to a specified thickness. The regulating member is disposed at a position downstream of the supply station and upstream of the supply position in the direction of rotation of the liquid material holding member. The supplier further includes a removing member disposed at a position downstream of the supply station and upstream of the regulating member in the direction of rotation of the liquid material holding member.

28 Claims, 9 Drawing Sheets

200

136
driving circuit
132
driving circuit
42
controller
44
M1
46
S
27
29
20
26
10
22
12
14
32
6

Fig.10 < PRIOR ART >
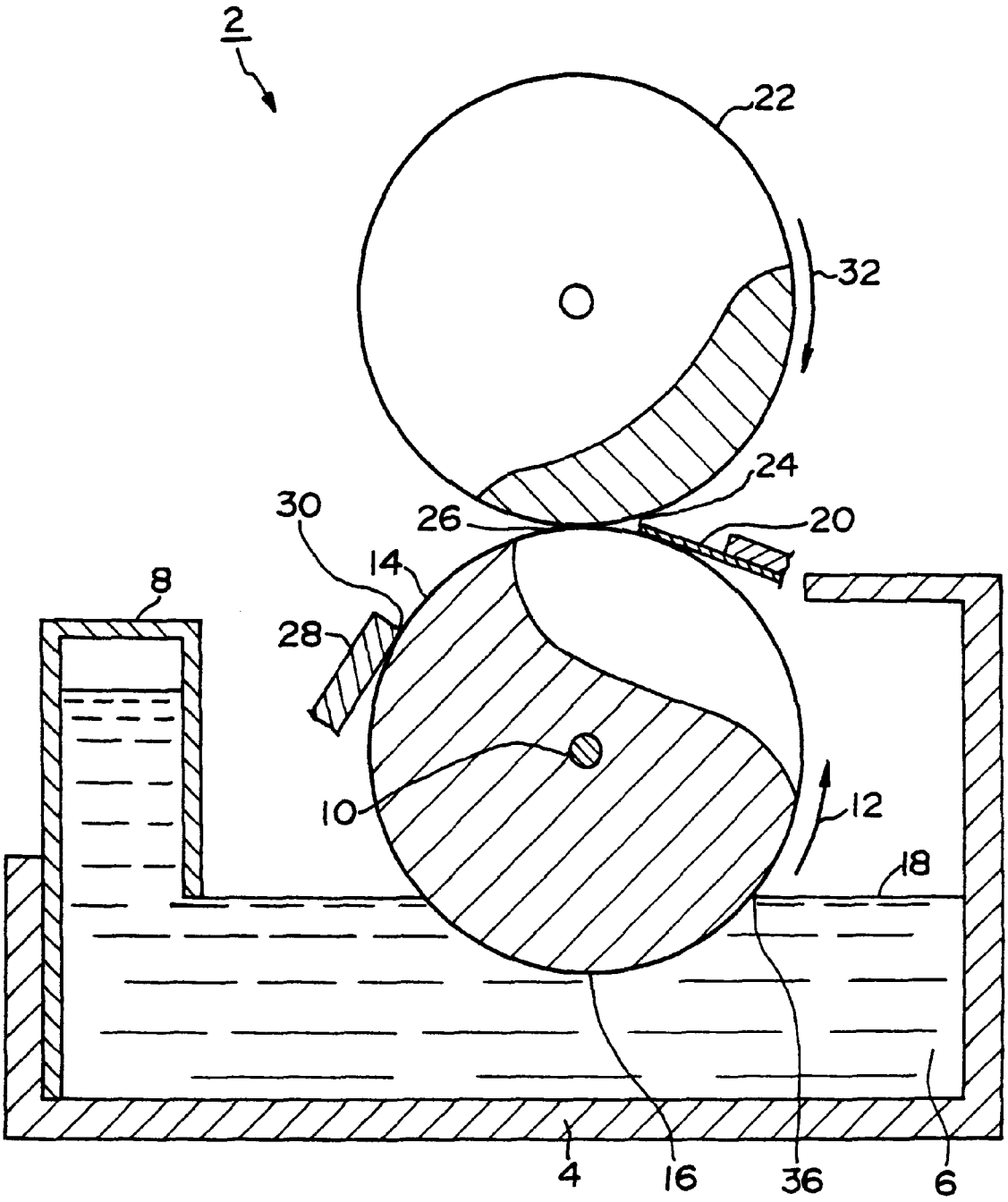

LIQUID MATERIAL SUPPLIER AND IMAGE FORMING APPARATUS COMPRISING THE SAME

This application is based on Japanese Patent Applications Nos. 11-55297 and 11-105139 filed in Japan on Mar. 3, 1999, and on Apr. 13, 1999, the entire content of which is hereby incorporated by reference.

BACKGROUND OF THE INVENTION

1. Field of the Invention

The present invention relates to a liquid material supplier for causing a liquid material, such as ink, to be held in a uniform thin layer on a surface of a liquid material holding member, such as a roller or belt, and to an image forming apparatus having the liquid material supplier incorporated therein.

2. Description of Related Art

A printer, an image forming apparatus, or the like using a liquid material such as a liquid ink is so constructed as to form the liquid ink adhering to a rotating roller as a liquid material holding member into a uniform thin layer by using a regulating blade, transfer the thin layer onto a form plate or an image carrying member, and then scrape the ink remaining on the rotating roller therefrom by using a removing blade.

FIG. 10 shows a conventional ink supplier 2 using such a removing blade. The ink supplier 2 comprises a container 4 for containing ink 6. The ink 6 is supplied from an ink cartridge 8 to the container 4. In the upper part of the container 4, a roller 14 which rotates around a shaft 10 extending perpendicularly to the paper surface and in the direction indicated by the arrow 12 in the drawing is disposed such that the lowermost portion 16 of the roller 14 underlies an ink liquid level 18, i.e., a part of the roller 14 is constantly immersed in the ink 6. On the side portion of the roller 14, a regulating blade 20 composed of a plate-like elastic member is provided fixedly. The regulating blade 20 protrudes generally tangentially to the roller 14 and downstream in the direction of rotation of the roller 14 to be in contact with the roller 14. Another roller 22 is provided over the roller 14 in a contact relationship with the roller 14. On the side portion of the roller 14, there is further provided a removing blade 28 in a contact relationship with the roller 14 at a position downstream of a contact portion 24 with the regulating blade 20 and a contact portion 26 with the other roller 22 in the direction of rotation of the roller 14. The removing blade 28 is formed of a single plate-like elastic member and directed generally tangentially to the roller 14 and upstream of the roller 14 in the direction of rotation of the roller 14.

Next, a description will be given to the operation of the ink supplier 2 with reference to FIG. 10. The ink 6 adhering to the surface of the roller 14 below the ink liquid level 18 is pumped up with the rotation of the roller 14 to reach a tip portion 24 of the regulating blade 20. The ink 6 receives a given pressure from the tip portion 24 of the regulating blade 20, whereby the surplus ink 6 is scraped off and removed by the regulating blade 20 and a thin layer of the ink 6 having a desired uniform film thickness in accordance with the tip pressure of the regulating blade 20 is formed on the surface of the roller 14. Thereafter, the tin-film ink 6 is transferred, i.e., supplied to the surface of the other roller 22 rotating in the opposite direction (rotation indicated by the arrow 32) to the roller 14, while keeping contact with the roller 14, at the contact portion (supply position) 26. After that, the ink 6 remaining on the surface of the roller 14 reaches the tip portion 30 of the removing blade 28. Since the tip portion 30 of the removing blade 28 is in contact with the roller 14, while being oriented in such a direction (direction indicated by the arrow 12) as to collide with the direction of rotation of the roller 14, the remaining ink 6 is scraped off by the tip portion 30 to return into the container 4. Accordingly, the ink 6 does not remain on the surface of the roller 14 after it has passed through the tip portion 30 of the removing blade 28.

The refreshed surface of the roller 14 from which the remaining ink 6 has been scraped is immersed again in the liquid ink 6 by the rotating operation of the roller 14 to be prepared for another transfer to the roller 22, i.e., another ink supply. In the ink supplier 2 with the conventional structure, therefore, the thin layer of the ink 6 is constantly formed on the surface portion of the roller 14 lying between the position 36 at which the roller 14 emerges from the ink liquid level and the position at which the surface of the roller 14 comes in contact with the tip portion 30 of the removing blade 28 regardless of whether an ink supply operation is being performed or halted. This particularly presents a problem when the time interval between the halting of the ink supply operation and the initiation of the subsequent ink supply operation is long. This is because the layer of the ink 6 dries during the long period of time and tends to stick to the surface of the roller 14 and there may be cases where an ink supply from the roller 14 to the roller 22 is not effected as desired due to the stuck ink 6 in the subsequent ink supply operations, with the result that a formed image is disturbed.

On the surface portion of the roller 14 lying between the regulating blade 20 and the removing blade 28 in the direction of rotation of the roller 14, the ink is thinly spread out to have a large contact area with an outer atmosphere so that such drying is especially likely to occur.

OBJECT AND SUMMARY

It is therefore an object of the present invention to provide an improved liquid material supplier and an image forming apparatus comprising the same, whereby the foregoing problems are solved.

Another object of the present invention is to provide a liquid material supplier capable of effectively preventing a liquid material, such as ink, held on a surface of a liquid material holding member from drying and an image forming apparatus comprising the same.

The foregoing objects are attained by providing a liquid material supplier and an image forming apparatus comprising the same, the liquid material supplier comprising:

- a liquid material holding member for holding a liquid material on a surface thereof, the liquid material holding member being rotatable in a predetermined direction and supplying, during rotation, the liquid material to a member to be supplied at a given supply position;
- a driver for driving and rotating the liquid material holding member in the predetermined direction;
- a supply station for supplying the liquid material to the surface of the liquid material holding member;
- a regulating member for regulating the liquid material on the liquid material holding member to a specified thickness, the regulating member being disposed at a position downstream of the supply station and upstream of the supply position in the direction of rotation of the liquid material holding member;
- a removing member for removing the liquid material from the surface of the liquid material holding member; and a controller for selectively effecting a supply mode for supplying the liquid material from the liquid material holding member to the member to be supplied or a removal mode for removing the liquid material from the surface of the liquid material holding member.

In the supplier, the removing member may also be disposed at a position downstream of the supply station and upstream of the regulating member in the direction of rotation of the liquid material holding member. In this case, the controller preferably controls the removing member such that the removing member is brought away from the surface of the liquid material holding member in the supply mode and into contact with the surface of the liquid material holding member in the removal mode. More preferably, the removing member is disposed adjacent the supply station.

In the supplier, the controller may also control the driver such that the liquid material holding member is rotated at a speed lower in the removal mode than in the supply mode.

In the supplier, the removing member may also be disposed at a position downstream of the supply position and upstream of the supply station in the direction of rotation of the liquid material holding member, and the controller may also control the driver such that the liquid material holding member is rotated in the predetermined direction in the supply mode and rotated in the direction opposite to the predetermined direction in the removal mode. More preferably, the removing member is disposed adjacent the supply station.

In the supplier, the supply station may also include a container for containing the liquid material and the liquid material holding member may be disposed such that a portion thereof is immersed in the liquid material contained in the container.

BRIEF DESCRIPTION OF THE DRAWINGS

These and other objects and features of the present invention will become clear from the following description taken in conjunction with the preferred embodiments thereof with reference to the accompanying drawings, in which:

FIG. 10 is a view showing a conventional ink supplier.

DETAILED DESCRIPTION OF THE PREFERRED EMBODIMENTS

Figure 1:
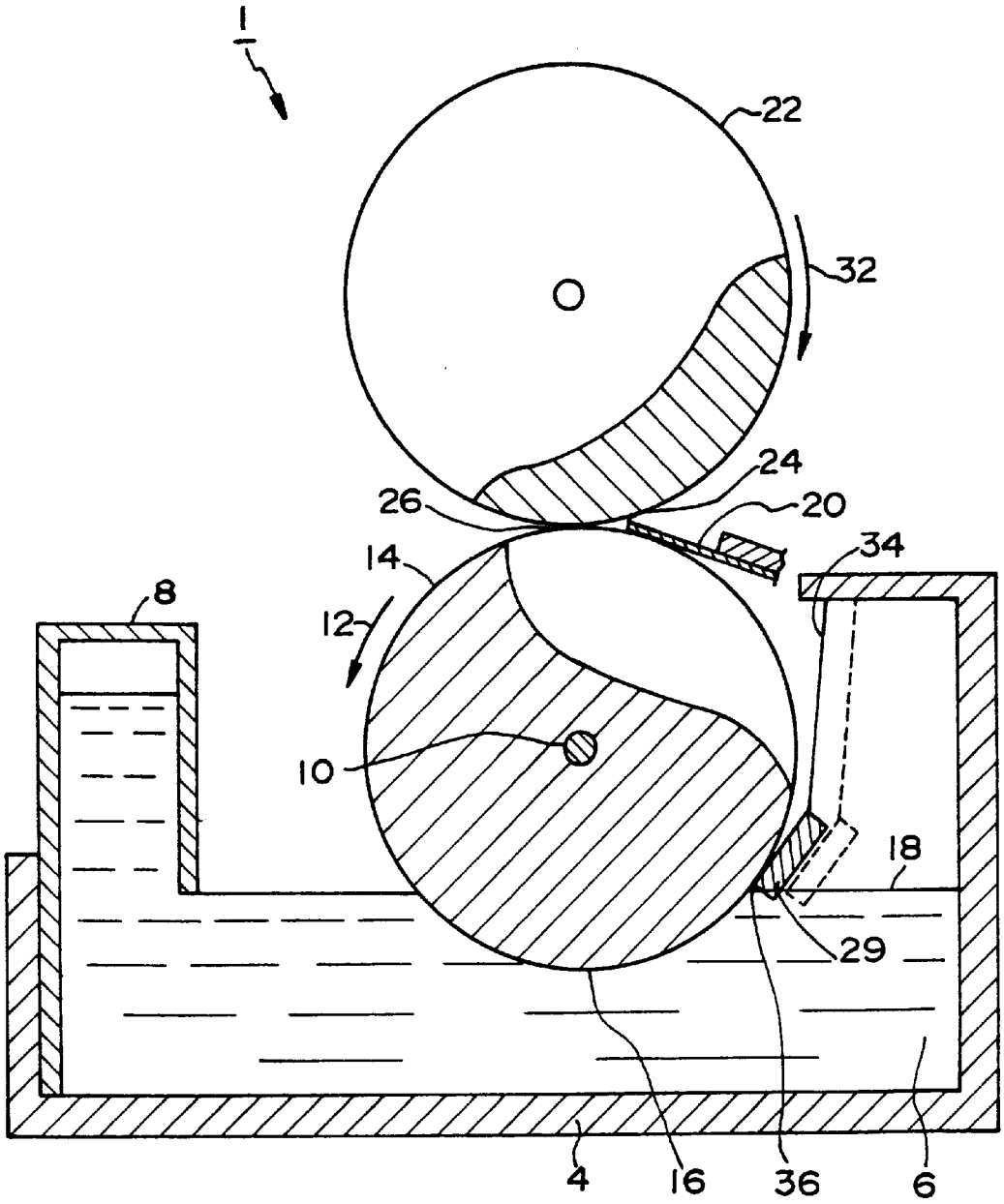
FIG. 1 is a view showing an ink supplier as a first embodiment.

FIG. 1 is a view showing an ink supplier 1 as a first embodiment of the present invention. The supplier has nearly the same structure as the conventional ink supplier 2 shown in FIG. 10 except that the mounting position and operation of the removing blade and the operation of a roller 14 are different. Therefore, the description of the components corresponding to the ink supplier 2 of FIG. 10 will be omitted by retaining the same reference numerals.

In the ink supplier 1, a removing blade 29 is disposed upstream of a regulating blade 20 in the direction of rotation of the roller 14, downstream of a position 36 at which the surface of the roller 14 emerges from an ink liquid level, and adjacent the position 36 at which the surface of the roller 14 emerges from the ink liquid level. In the ink supplier 1 of the present embodiment also, the removing blade 29 is formed of a plate like elastic member and directed generally tangentially to the roller 14 and upstream in the direction of rotation of the roller 14, similarly to the conventional ink supplier 2. The removing blade 29 is designed to be movable between a first position at which the removing blade 29 is not in contact with the roller 14 (position indicated by the broken line in FIG. 1) and a second position at which the removing blade 29 is in contact with the roller 14 (position indicated by the solid line in FIG. 1) by the operation of a support member 34. The support member 34 is composed of a rigid member and disposed to expand downwardly from an upper portion of a container 4. An upper portion of the removing blade 29 which is not in contact with the roller is fastened to a lower portion of the support member 34.

The roller 14 is rotating in the same manner not only when the ink supplier 1 is in an ink supply operation but also for a specified period of time after the completion of the ink supply operation. A description will be given below to the respective operations of the removing blade 29 and the roller 14.

Figure 2:
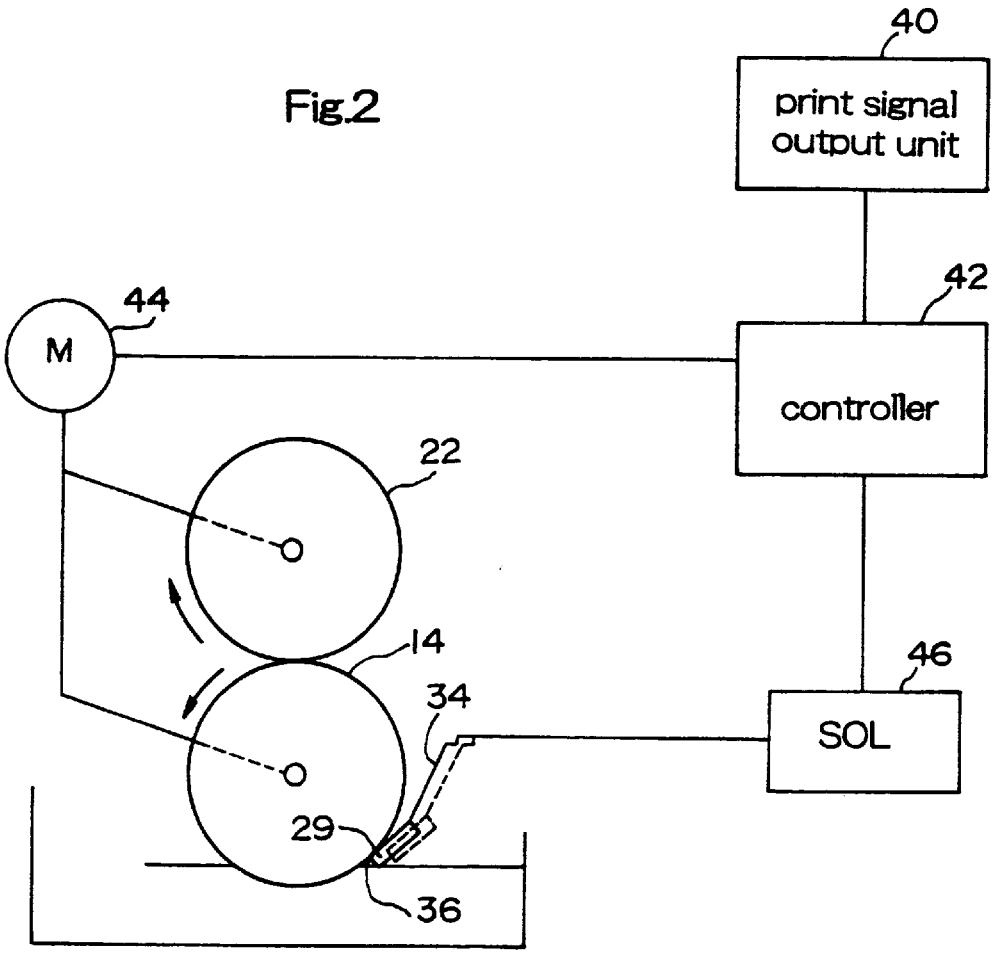
FIG. 2 is a schematic block diagram showing a print signal output unit, a roller, a motor, a removing blade, a support member, and a solenoid element.
Figure 3A:
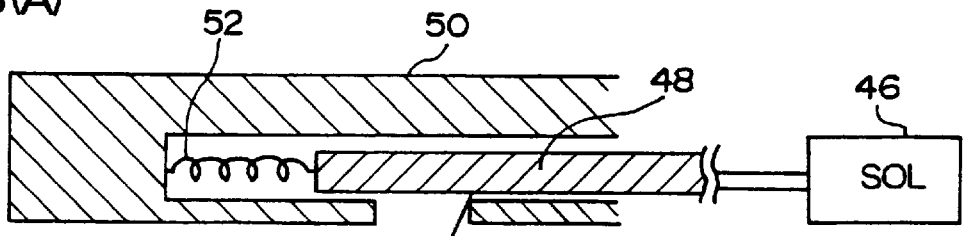
FIGS. 3(A) and 3(B) are enlarged cross-sectional views of an upper portion of the support member and a portion of a container associated therewith, which are for illustrating the respective operations of the removal blade and the support member.
Figure 3B:
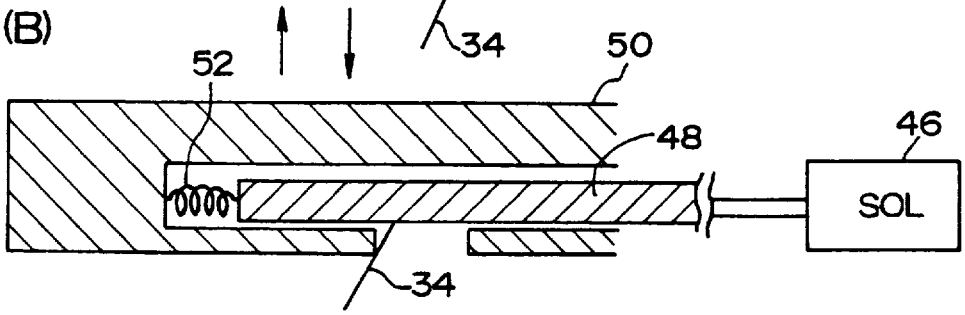
Figure 4:
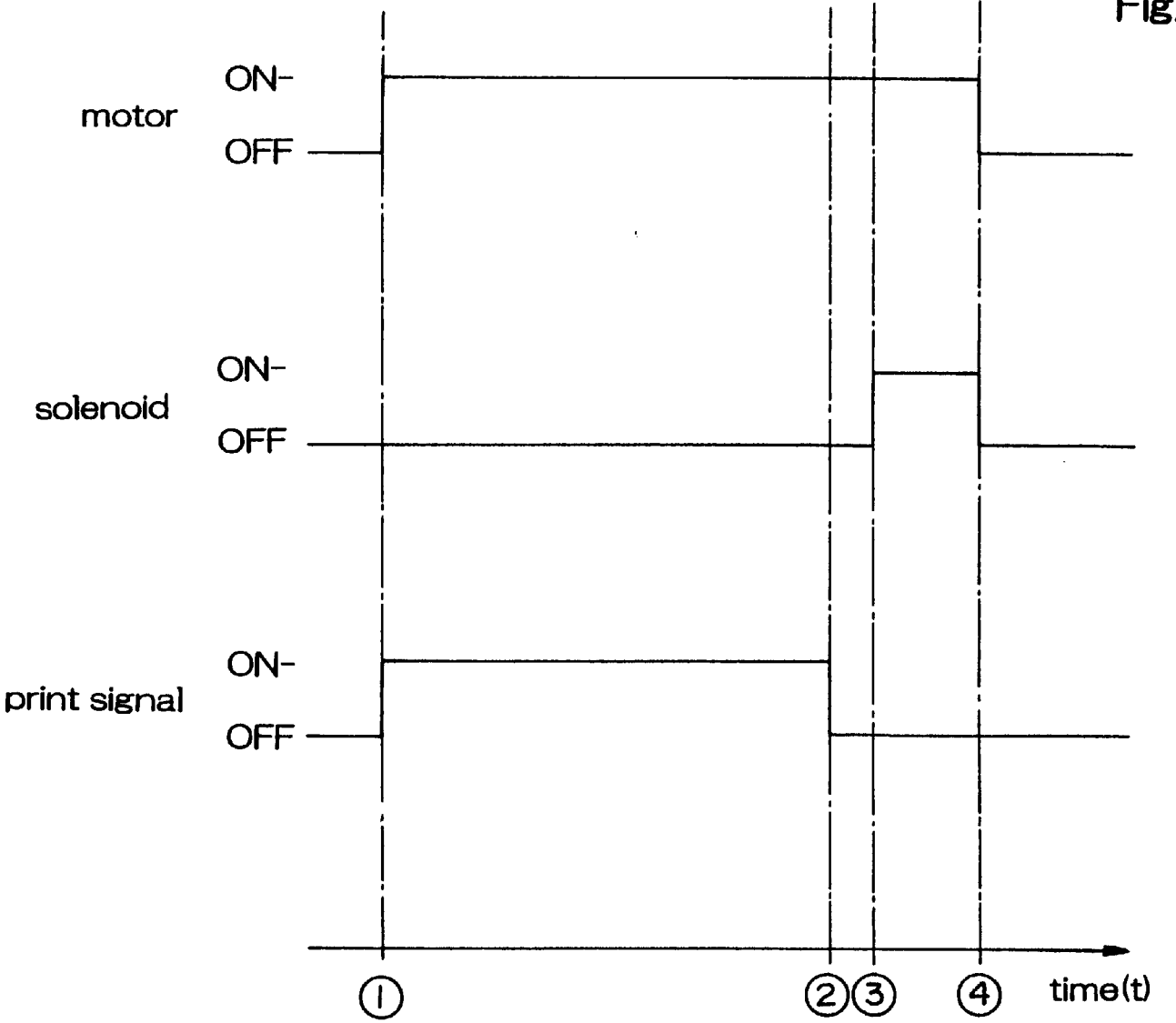
FIG. 4 is a schematic time chart of the respective operations of the removal blade (i.e., the solenoid element) and the roller (i.e., the motor) when an output is produced from the print signal output unit.

FIG. 2 is a schematic block diagram showing a print signal output unit 40, the roller 14, a motor 44 for moving the roller, the removing blade 29, the support member 34, and a solenoid element 46 for moving the support member 34. FIG. 4 is a schematic time chart of the respective operations of the removing blade 29 (i.e., the solenoid element 46) and the roller 14 (i.e., the motor 44 for moving the roller) when an output is produced from the print signal output unit 40 of FIG. 2. FIGS. 3(A) and 3(B) are enlarged cross-sectional views of an upper portion of the support member 34 and a portion of the container 4 associated therewith, which are for illustrating the respective operations of the removing blade 29 and the support member 34. The functions and operations of the components shown in the block diagram of FIG. 2 will be described with reference to the time chart shown in FIG. 4.

From the print signal output unit 40, a print signal is outputted to an image producing mechanism (not shown). When the print signal output unit 40 is brought into an output state, the controller 42 drives the motor 44, whereby the first roller 14 and the second roller 22 initiate rotating operations at the time 1 (FIG. 4). The ink is pumped up by the rotation of the first roller 14 to form a thin layer of the ink 6 on the surface of the first roller 14. On the other hand, a latent image transfer to the second roller 22 is initiated to initiate development.

When the outputting of the print signal is completed (at the time 2), development (i.e., the latent image transfer) is also completed. At the time 2 at which the outputting of the print signal is completed, the print signal output unit 40 shifts from the output state to a non-output state. For a specified time after the shift to the non-output state, i.e., till the time 4 in FIG. 4, the controller 42 continuously drives the motor 44 and controls the first roller 14 such that it continues rotation. A description will be given later to the time interval between the times 2 and 4.

When the time 3 is reached after a specified time elapsed from the time at which the print signal output unit 40 shifted from the output state to the non-output state, i.e., from the time 2, the controller 42 allows a current to flow in the solenoid element 46 to operate the solenoid element 46. The time 3 precedes the time 4.

The removing blade 29 has the upper portion fastened to the lower portion of the support member 34 which has the upper portion fastened to blade pressing means 48. The blade pressing means 48 is a rigid plate-like member designed to move slidably in the horizontal direction within container wall 50 with a hollow portion formed in a part of the upper portion of the container 4 (see FIGS. 3(A) and (B)). The container wall 50 with the hollow portion formed in the part thereof and accommodating the blade pressing means 48 in the hollow portion is a wall of the container 4 forming a part of the container 4, located above the ink liquid level by a given distance, and extending in the horizontal direction, as shown in FIG. 1. As shown in FIGS. 3(A) and 3(B), a single or plurality of springs 52, e.g., are disposed between an end of the blade pressing means 48 and the inner surface of the container wall opposed thereto.

FIG. 3(A) shows the situation in which a current is not allowed to flow in the solenoid element 46, i.e., in which the solenoid element 46 is not operating. In this situation, the spring 52 tends to retain a natural length so that the blade pressing means 48 keeps the rightmost position in the drawing. Consequently, the removing blade 29 is fixed at a distance from the roller 14.

FIG. 3(B) shows the situation in which a current is allowed to flow in the solenoid element 46, i.e., in which the solenoid element 46 is operating. In the present embodiment, the solenoid element 46 is so constructed as to continuously press the blade pressing means 48 to the left in the drawing with the current allowed to flow therein. At this time, the spring 52 is contracted but the blade pressing means 48 moves to the left in the drawing till the pressing force exerted by the solenoid element 46 on the blade pressing means 48 compares with the drag of the spring 52 resulting from the contraction of the spring 52. As a result, the removing blade 29 is brought into contact with the roller 14.

If the controller 42 performs a control operation at the time 3 to operate the solenoid element 46 by allowing a current to flow in the solenoid element 46, the removing blade 29 comes in contact with the roller 14. Since the tip portion of the removing blade 29 is oriented in such a direction as to collide with the direction of rotation of the roller 14, similarly to the prior art case described above (see FIG. 10), the ink 6 adhering to the surface of the roller 14 is scraped therefrom by the tip portion of the removing blade 29. Specifically, a current is allowed to flow in the solenoid element 46 to cause the solenoid element 46 to press the blade pressing means 48 against the spring 52 to such a degree that the removing blade 29 is brought into contact with the roller 14 and the ink 6 adhering to the surface of the roller 14 is scraped therefrom. Thus, the thin layer of the ink adhering to the surface when the surface of the roller 14 is immersed in the ink liquid 6 is scraped off by the removing blade 29 immediately after the surface of the roller 14 passes through the position 36 at which the roller 14 emerges from the ink liquid level.

The controller 42 allows a current to flow in the solenoid element 46 such that the state in which the removing blade 29 is in contact with the roller 14 continues till the time 4. In the mean time also, the controller 42 drives the motor 44 such that the roller 14 continues rotation. In due course, the state is reached in which no ink adheres to the surface portion of the roller 14 (except for the portion underlying the ink liquid level) located downstream of the position at which the removing blade 29 is in contact with the roller 14 in the direction of rotation of the roller 14. When the state is reached (the time 4), the controller 42 stops allowing the current to flow in the solenoid element 46. At the same time, the controller 42 stops driving the motor 44 and the roller 14 stops rotating.

As described above, a given time interval is provided between the time (time 2) at which the print signal output unit 40 shifted from the output state to the non-output state and the time (time 3) at which the controller 42 performs the control operation to operate the solenoid element 46 by allowing a current to flow in the solenoid element 46. This is for preventing the cleaning of the roller 14 (ink removal) in the case where the subsequent print signal is generated after a short period of time has elapsed from the completion of the outputting of the print signal. In other words, the cleaning of the roller 14 is conducted only after the given time has elapsed from the completion of the outputting of the print signal by considering that a sequence of print operations are substantially completed.

The time interval between the times 3 and 4 (time 3–4) has been determined by assuming, to be a lower limit time, the time required by an arbitrary point on the surface of the roller 14 to move rotatively from the position at which the removing blade 29 is in contact with the roller 14 in the direction of rotation of the roller 14 and reach the position at which the surface of the roller 14 is submerged again in the ink to underlie the ink liquid level. In other words, the time required by the removal of the adhering ink from the surface portion of the roller 14 lying between the position at which the removing blade 29 is in contact with the roller 14 and the position at which the surface of the roller 14 is submerged again in the ink to underlie the ink liquid level as a result of the rotating operation of the roller 14 and the continued contact of the removing blade 29 with the roller 14 is assumed to be a lower limit time.

Thus, since the ink has been removed from nearly the entire surface portion of the roller 14 lying above the ink liquid level at the time 4 at which the roller 14 stops rotating and thereafter, such a phenomenon that the ink on the surface of the roller 14 dries and adheres thereto does not occur even after the lapse of a long time.

The mechanism for causing the effect of bringing the removing blade 29 into contact with the surface of the roller 14 and continuously pressing the removing blade 29 against the surface of the roller 14 is not limited to the foregoing mechanism using the solenoid element 46. There may also be used a mechanism using, e.g., a motor, a spring, or the like. The member for causing the effect of bringing the removing blade 29 away from the surface of the roller 14 is not limited to the foregoing spring 52. For example, there may also be used a solenoid element or a motor.

In the first embodiment described above, the removing blade 29 is brought into contact with and away from the surface of the roller 14 by parallel movement. The operation of the removing blade 29 is not limited to such a mode by parallel movement. For example, it is also possible to adopt an operating mode by rotating (or arcuate orbital) movement centering around a hinge shaft in which the support member 34 is connected to the container wall 50 by using a hinge. In the mode also, the position of the removing blade 29 can be controlled by adjusting the balance between the pressing force exerted by the solenoid element and the drag of the spring.

Figure 5:
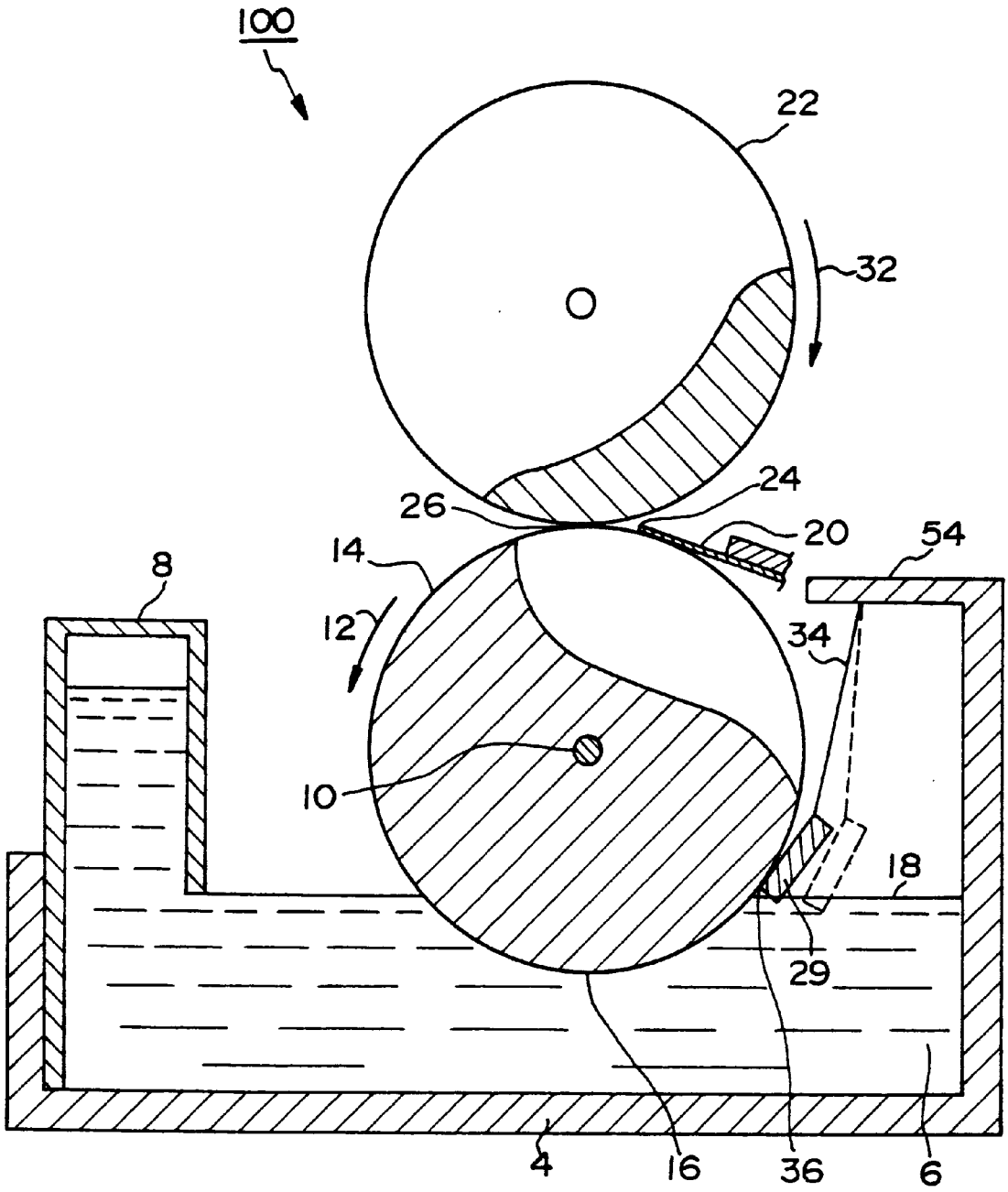
FIG. 5 is a view showing an ink supplier as a second embodiment.

FIG. 5 is a view showing an ink supplier 100 as a second embodiment of the present invention, in which such a support member 34 and a removing blade 29 move in an arcuate orbit centering around a hinge shaft 54. The ink supplier 100 of the second embodiment has the same structure and operation as the ink supplier 1 of the first embodiment except for the mechanism for moving the removing blade 29. Accordingly, an overlapping description will be omitted by retaining the same reference numerals for the corresponding components. The removing blade 29 is designed to be movable between a first position at which it is not in contact with the roller 14 (position indicated by the broken line in FIG. 5) and a second position at which it is in contact with the roller 14 (position indicated by the solid line in FIG. 5) by the arcuate orbital movement of the support member 34.

Figure 6A:
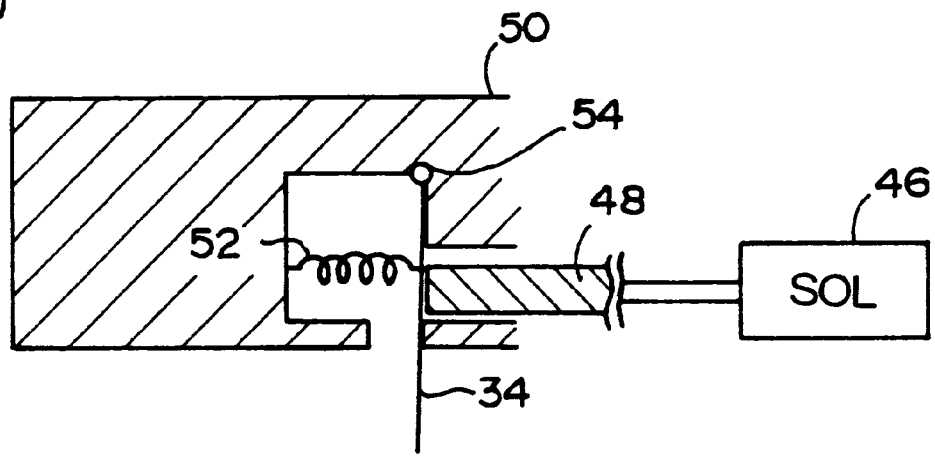
FIGS. 6(A) and 6(B) show the inside of the container wall with a hollow portion formed in a part of an upper portion of the container.
Figure 6B:
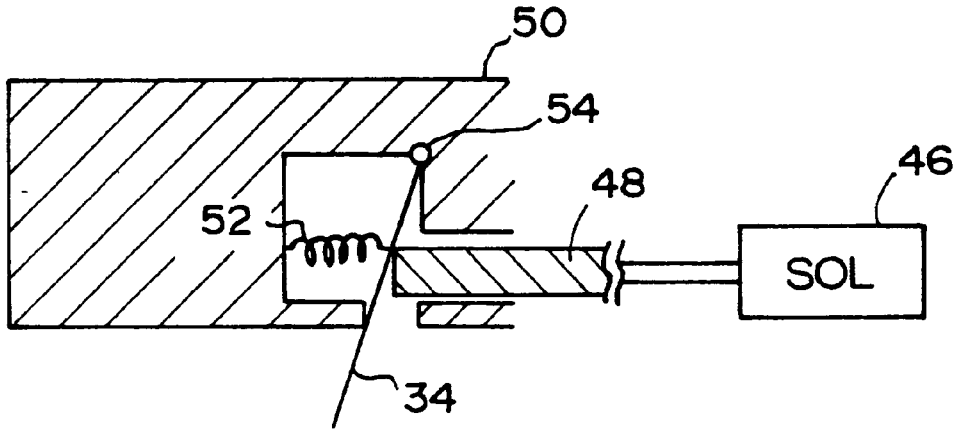

FIGS. 6(A) and 6(*b*) are views showing the inside of a container wall 50 with a hollow portion formed in a part of an upper portion of a container 4 in the ink supplier 100 of the second embodiment. The support member 34 is connected to the top face of the hollow portion by using the hinge shaft 54. As shown in FIGS. 6(A) and 6(B), a single or plurality of springs 52 having both ends fastened to the support member 34 and to the inner surface of the container wall, respectively, are disposed between the support member 34 and the inner surface of the container wall opposed thereto in the horizontal direction. Blade pressing means 48 capable of moving slidably in the horizontal direction within the container wall 50 is disposed at the back side of the surface of the support member 34 on which the spring 52 is disposed in a contact relationship with the support member 34.

FIG. 6(A) shows the situation in which a current is not allowed to flow in a solenoid element 46, i.e., in which the solenoid element 46 is not operating. In the situation, the spring 52 tends to retain a natural length so that the support member 34 and the blade pressing means 48 positioned posterior to the support member 34 keeps positions on the right end of the drawing. Accordingly, the removing blade 29 is fixed at a distance from the roller 14.

FIG. 6(B) shows the situation in which a current is allowed to flow in the solenoid element 46, i.e., the solenoid element 46 is operating. In the present embodiment also, the solenoid element 46 is so constructed as to continuously press the blade pressing means 48 to the left in the drawing with the current allowed to flow therein. Accordingly, the blade pressing means 48 presses the support member 34 to the left. Since the support member 34 has an upper end connected to the hinge shaft 54, the support member 34 swings to the left in the arcuate orbit centering around the hinge shaft 54. At this time, the spring 52 is contracted but the blade pressing means 48 moves to the left in the drawing till the pressing force exerted by the solenoid element 46 on the blade pressing means 48 and on the support member 34 compares with the drag of the spring 52 resulting from the contraction of the spring 52, so that the support member 34 and the removing blade 29 swing to the left. As a result, the removing blade 29 is brought into contact with the roller 14.

The operating mode by rotating movement is advantageous over the operating mode by parallel movement in that the space required by the operations of the removing blade 29 and the support member 34 can be reduced. This allows the scaling down of the whole container 4.

In the two embodiments described above, the removing blade 29 is disposed downstream of and adjacent the position 36 in the direction of rotation of the roller 14 at which the surface of the roller 14 emerges from the ink liquid level. However, the removing blade 29 may also be disposed upstream of and adjacent the position 36 at which the surface of the roller 14 emerges from the ink liquid level in the direction of rotation of the roller 14 (i.e., below the ink liquid level). Even in such a structure, if the roller 14 is rotated at a high speed, the surface portion of the roller 14 lying downstream of the point at which the tip portion of the removing blade 29 is in contact with the surface of the roller 14 retains the state in which an ink 6 has been scraped off. Compared with the foregoing embodiments, the variation is advantageous in that the ink has been scraped off the entire surface portion of the roller 14 exposed at the ink liquid level 18 when the rotation of the roller 14 is halted. Moreover, since the tip of the removing blade 29, particularly the portion thereof in contact with the roller 14, can be held below the ink liquid level when the rotation of the roller 14 is halted, the variation is also advantageous in that the ink adhering to the contact portion of the removing blade 29 is not solidified.

In an embodiment in which the removing blade 29 is disposed below the ink liquid level 18, it was experimentally proved that the roller 14 should be rotated at a high speed such that the surface of the roller 14 moves at a speed between 100 mm/sec and 700 mm/sec. So long as the speed at the surface of the roller 14 was between 300 mm/sec and 500 mm/sec, a more preferable result was obtained.

Figure 7:
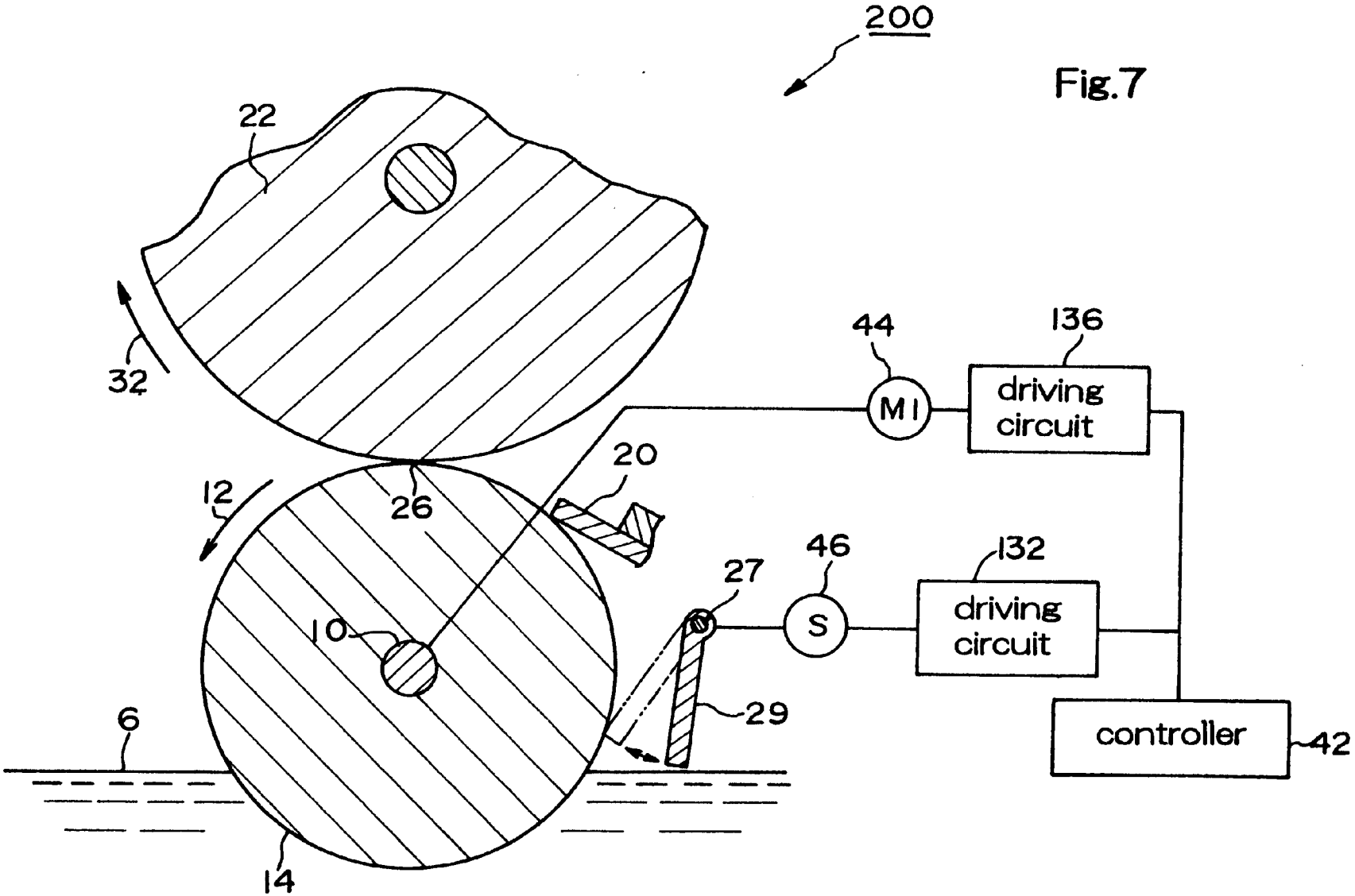
FIG. 7 is a view showing an ink supplier as a third embodiment.

FIG. 7 is a view showing an ink supplier 200 as a third embodiment of the present invention. As for the components corresponding to those of the ink supplier 1 (see FIG. 1) of the first embodiment, an overlapping description will be omitted by retaining the same reference numerals.

A removing blade 29 rotatable around a shaft 27 extending perpendicularly to the paper surface is provided between the portion of a roller 14 immersed in ink 6 and a regulating blade 20 in a direction 12 of rotation of the roller 14 and adjacent the liquid level of the ink 6. The removing blade 29 is movable between a first position (position indicated by the solid line in FIG. 7) at which the removing blade 29 is away from the surface of the roller 14 and a second position (position indicated by the broken line in FIG. 7) at which the removing blade 29 is brought into contact with the roller 14 to remove the ink 6 from the surface of the roller 14.

The removing blade 29 is biased with a spring or the like toward the first position. The removing blade 29 is coupled to a solenoid 46 which is connected to a controller 42 via a first driving circuit 132. The solenoid 46 is activated with a current supplied from the first driving circuit 132 to the coil of the solenoid 46 in response to a signal from the controller 42. This allows the removing blade 29 to move from the first position to the second position.

A shaft 10 of the roller 14 is coupled to a motor 44 which is connected to the controller 42 via a second driving circuit 136. In response to a signal from the controller 42, the second driving circuit 136 rotates the roller 14 at a predetermined speed (e.g., 300 mm/sec) in the direction indicated by the arrow 12 during ink supply (in a supply mode) by a control operation such as pulse width modulation (PWM), while rotating the roller 14 at a speed (e.g., 100 mm/sec) lower than the predetermined speed during cleaning (in a removal mode).

During ink supply, the removing blade 29 is located at the first position at which the removing blade 29 is away from the roller 14 and the ink 6 adheres to the outer circumferential surface of the roller 14 with the rotation of the roller 14. Then, a thin layer of the ink 6 is formed on the roller 14 by the regulating blade 20 at the contact portion between the roller 14 and the regulating blade 20. Thereafter, the thin-layer ink 6 is transferred, i.e., supplied to another roller 22 at a supply position 26.

The removal of the ink for cleaning is performed after ink supply is completed. At this time, the first driving circuit 132 activates the solenoid 46 in response to the signal from the controller 42, whereby the removing blade 29 moves to the second position. The second driving circuit 136 rotates the roller 14 at a speed lower than during ink supply in response to the signal from the controller 42. Since the rotation speed of the roller 14 is lower than during ink supply, the amount of the ink pumped up with the rotation of the roller 14 during cleaning is smaller than during ink supply, so that the ink exerts a lower pressure on the removing blade 29. As a result, the ink 6 on the outer circumferential surface of the roller 14 is sufficiently removed by the removing blade 29.

The second driving circuit 136 halts the roller 14 in response to the signal from the controller 42 after a given time (at least the time that elapses before the portion of the roller in contact with the removing blade 29 immediately after the initiation of cleaning submerges again in the ink to underlie the liquid level thereof) has elapsed since the removing blade 29 moved to the second position and initiated cleaning. In the third embodiment, the roller 14 and the removing blade 29 come in contact with each other adjacent the liquid level of the ink in the direction of rotation of the roller 14. As a result, the ink 6 having adhered to the surface of the roller in a container 4 (see FIG. 1) is removed by the removing blade 29 immediately after emerging from the liquid level of the ink. After the roller is halted, therefore, the ink 6 no more remains on the outer circumferential surface portion of the roller located above the liquid level of the ink.

Figure 8:
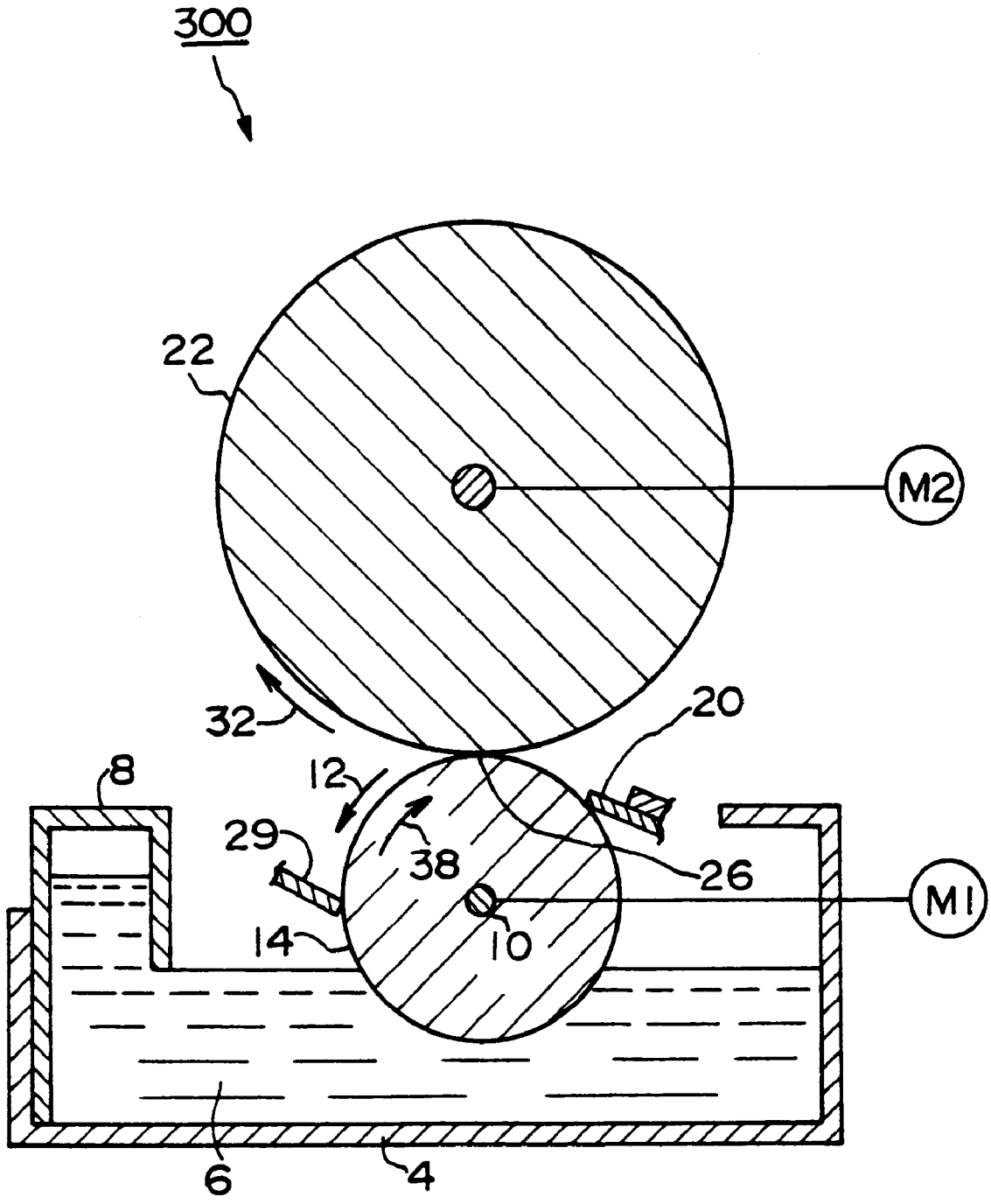
FIG. 8 is a view showing an ink supplier as a fourth embodiment.

FIG. 8 is a view showing an ink supplier 300 as a fourth embodiment of the present invention. As for the components corresponding to those of the ink supplier 1 (see FIG. 1) of the first embodiment, an overlapping description will be omitted by retaining the same reference numerals. In the ink supplier 300, a removing blade 29 is provided upstream of the portion of a roller 14 immersed in ink 6 in a direction 12 of rotation of the roller 14 and adjacent the liquid level of the ink. During cleaning (removal mode), the roller 14 is rotated in the direction (direction indicated by the arrow 38 in the drawing) opposite to the direction of rotation of the roller 14 during ink supply (supply mode) and at a circumferential speed lower than that of the roller 14 during ink supply. This enables effective removal of the ink on the roller 14 therefrom. In this case, it is unnecessary to retract the removing blade 29 during ink supply.

Figure 9:
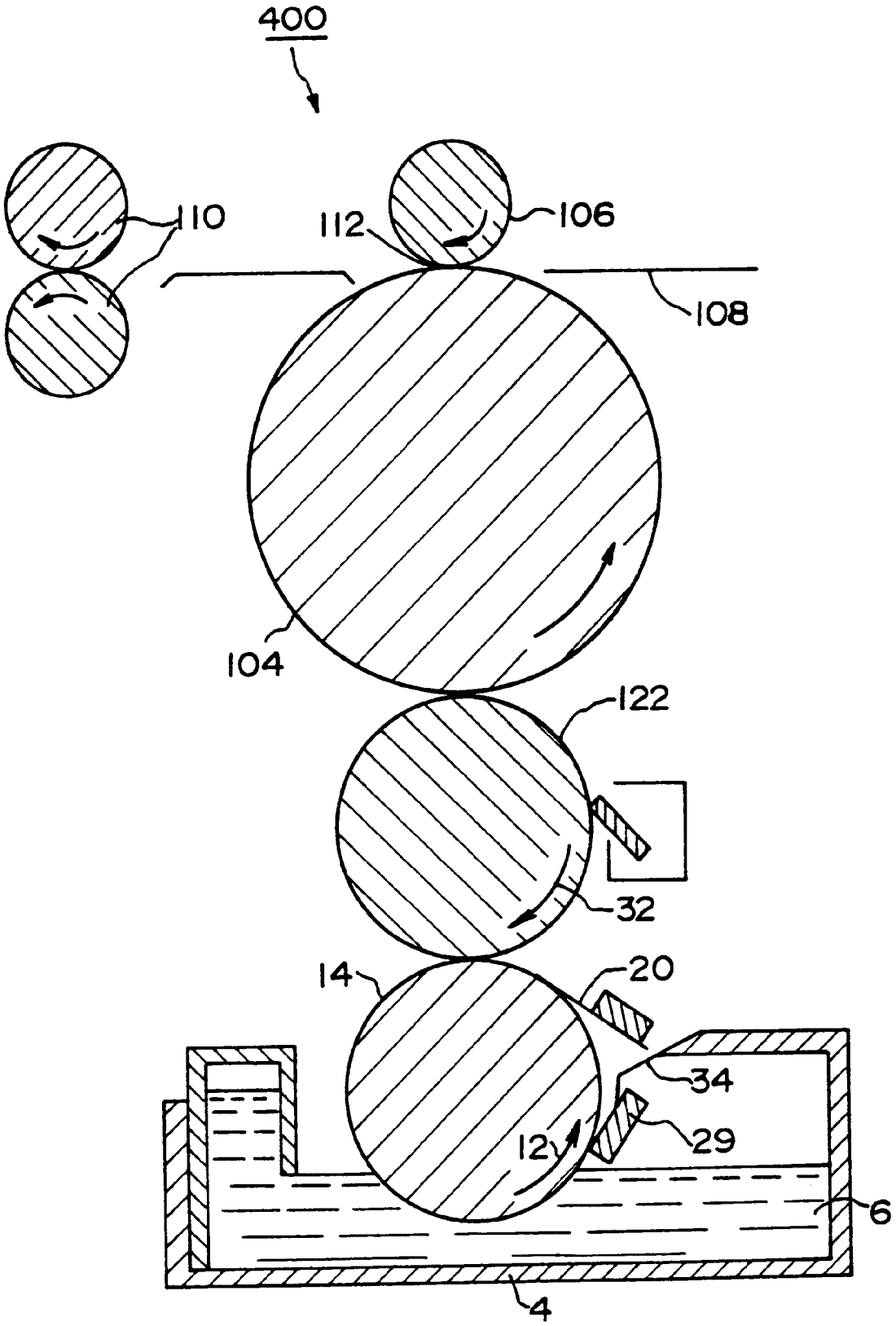
FIG. 9 is a view showing an embodiment of an image forming apparatus comprising an ink supplier according to the present invention.

FIG. 9 shows an image forming apparatus 400 as an embodiment of an image forming apparatus comprising an ink supplier according to the present invention. The ink 6 pumped up by a supply roller 14 provided in an ink supplier of the present invention is transferred onto a development roller 122 rotating in the opposite direction to the supply roller 14, while keeping contact with the supply roller 14. The thin-film ink 6 transferred onto the surface of the development roller 122 is further transferred onto an image carrying roller 104 holding a latent image and rotating in the opposite direction to the development roller 122, while keeping contact with the development roller 122. Development is effected at the image carrying roller 104. The image carrying roller 104 is rotating, while keeping contact with a transfer roller 106 rotating in the opposite direction to the image carrying roller 104. At a contact portion 112 between the two rollers, a transfer sheet 108 transported by a transporting mechanism (not shown) from upstream in the direction of rotation of the two rollers is held between the two rollers. The image on the image carrying roller 104 is made apparent on the transfer sheet 108 with the ink 6 and transported downstream in the direction of rotation of the two rollers by the rotating operation. A fixer 110 is provided at the destination of the transfer sheet 108 so that the ink on the transfer sheet is fixed by the fixer 110. It is to be noted that the ink supplier incorporated in the image forming apparatus 400 may be any of the foregoing ink suppliers of the first to fourth embodiments. It is also possible to supply the ink from the roller 14 directly to the image carrying roller 104 without providing the development roller 122.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

Although the regulating blade 20 has been disposed to protrude generally tangentially to the roller 14 and downstream in the direction of rotation of the roller 14 in each of the foregoing embodiments, the regulating blade 20 may also be disposed to protrude upstream in the direction of rotation of the roller 14 depending on the positional relationship between itself and the other members.

Means for moving the removing blade 29 is not limited to the solenoid and various other means can be used instead.

The removing blade may be composed properly of an elastic member made of such a material as urethane rubber, nitrile rubber, or silicon rubber. As the removing blade, a blade comprising two plate-like elastic members may also be used. It is also possible to enhance the cleaning property by providing removing blades at two or more portions.

As a member for removing the liquid material on the roller 14 therefrom, a roller, a brush, or the like may also be used instead of the removing blade.

As a regulating member for forming a thin layer of ink, a roller or the like may also be used instead of the blade.

Although each of the foregoing embodiments has used the roller as the liquid material holding member, another member such as a belt may also be used instead.

The present invention is also applicable to a device using a liquid material other than ink.

As is apparent from the foregoing description, the liquid material supplier and the image forming apparatus comprising the same according to the present invention prevents a liquid on the liquid material holding member from drying even during the period during which operation is halted.

Moreover, the ink 6 as the liquid material on the roller 14 can be removed effectively by the removing blade as the removing member since the circumferential speed at which the roller 14 as the liquid material holding member is rotated is lower during cleaning than during ink supply.

Since the removing blade is disposed adjacent the liquid level of the ink, the ink adhering to the surface of the roller in the container 4 is removed by the removing blade immediately after emerging from the liquid level of the ink with the rotation of the roller 14. As a result, the ink 6 on the roller 14 is effectively prevented from remaining on the outer circumferential surface portion of the roller located above the liquid level of the ink and drying on the surface of the roller 14.

What is claimed is:

1. A liquid material supplier comprising:

a liquid material holding member for holding a liquid material on a surface thereof, the liquid material holding member being rotatable in a predetermined direction and supplying, during rotation, the liquid material to a member to be supplied at a given supply position;

a driver for driving and rotating the liquid material holding member in the predetermined direction;

a supply station for supplying the liquid material to the surface of the liquid material holding member;

a regulating member for regulating the liquid material on the liquid material holding member to a specified thickness, the regulating member being disposed at a position downstream of the supply station and upstream of the supply position in the direction of rotation of the liquid material holding member;

a removing member for removing the liquid material from the surface of the liquid material holding member; and a controller for selectively effecting a supply mode for supplying the liquid material from the liquid material holding member to the member to be supplied or a removal mode for removing the liquid material from the surface of the liquid material holding member.

2. A liquid material supplier as claimed in claim 1, wherein the removing member is disposed at a position downstream of the supply station and upstream of the regulating member in the direction of rotation of the liquid material holding member.

3. A liquid material supplier as claimed in claim 2, wherein the controller controls the removing member such that the removing member is brought away from the surface of the liquid material holding member in the supply mode and into contact with the surface of the liquid material holding member in the removal mode.

4. A liquid material supplier as claimed in claim 2, wherein the removing member is disposed adjacent the supply station.

5. A liquid material supplier as claimed in claim 1, wherein the controller controls the driver such that the liquid material holding member is rotated at a speed lower in the removal mode than in the supply mode.

6. A liquid material supplier as claimed in claim 5, wherein the removing member is disposed at a position downstream of the supply station and upstream of the regulating member in the direction of rotation of the liquid material holding member.

7. A liquid material supplier as claimed in claim 6, wherein the controller controls the removing member such that the removing member is brought away from the surface of the liquid material holding member in the supply mode and into contact with the surface of the liquid material holding member in the removal mode.

8. A liquid material supplier as claimed in claim 6, wherein the removing member is disposed adjacent the supply station.

9. A liquid material supplier as claimed in claim 1, wherein the removing member is disposed at a position downstream of the supply position and upstream of the supply station in the direction of rotation of the liquid material holding member, and the controller controls the driver such that the liquid material holding member is rotated in the predetermined direction in the supply mode and rotated in the direction opposite to the predetermined direction in the removal mode.

10. A liquid material supplier as claimed in claim 9, wherein the controller controls the driver such that the liquid material holding member is rotated at a speed lower in the removal mode than in the supply mode.

11. A liquid material supplier as claimed in claim 9, wherein the removing member is disposed adjacent the supply station.

12. A liquid material supplier as claimed in claim 1, wherein the supply station includes a container for containing the liquid material, and the liquid material holding member is disposed such that a portion thereof is immersed in the liquid material contained in the container.

13. A liquid material supplier as claimed in claim 1, wherein the liquid material holding member comprises a roller.

14. A liquid material supplier as claimed in claim 1, wherein the removing member comprises a blade.

15. An image forming apparatus comprising:

an image carrying member for carrying a latent image;

a liquid material holding member for holding a liquid material on a surface thereof, the liquid material holding member being rotatable in a predetermined direction and directly or indirectly supplying, during rotation, the liquid material to the image carrying member at a given supply position to visualize the latent image;

a driver for driving and rotating the liquid material holding member in the predetermined direction;

a supply station for supplying the liquid material to the surface of the liquid material holding member;

a regulating member for regulating the liquid material on the liquid material holding member to a specified thickness, the regulating member being disposed at a position downstream of the supply station and upstream of the supply position in the direction of rotation of the liquid material holding member;

a removing member for removing the liquid material from the surface of the liquid material holding member; and a controller for selectively effecting a supply mode for supplying the liquid material from the liquid material holding member to the image carrying member or a removal mode for removing the liquid material from the surface of the liquid material holding member.

16. An image forming apparatus as claimed in claim 15, wherein the removing member is disposed at a position downstream of the supply station and upstream of the regulating member in the direction of rotation of the liquid material holding member.

17. An image forming apparatus as claimed in claim 16, wherein the controller controls the removing member such that the removing member is brought away from the surface of the liquid material holding member in the supply mode and into contact with the surface of the liquid material holding member in the removal mode.

18. An image forming apparatus as claimed in claim 16, wherein the removing member is disposed adjacent the supply station.

19. An image forming apparatus as claimed in claim 15, wherein the controller controls the driver such that the liquid material holding member is rotated at a speed lower in the removal mode than in the supply mode.

20. An image forming apparatus as claimed in claim 19, wherein the removing member is disposed at a position downstream of the supply station and upstream of the regulating member in the direction of rotation of the liquid material holding member.

21. An image forming apparatus as claimed in claim 20, wherein the controller controls the removing member such that the removing member is brought away from the surface of the liquid material holding member in the supply mode and into contact with the surface of the liquid material holding member in the removal mode.

22. An image forming apparatus as claimed in claim 20, wherein the removing member is disposed adjacent the supply station.

23. An image forming apparatus as claimed in claim 15, wherein the removing member is disposed at a position downstream of the supply position and upstream of the supply station in the direction of rotation of the liquid material holding member, and the controller controls the driver such that the liquid material holding member is rotated in the predetermined direction in the supply mode and rotated in the direction opposite to the predetermined direction in the removal mode.

24. An image forming apparatus as claimed in claim 23, wherein the controller controls the driver such that the liquid material holding member is rotated at a speed lower in the removal mode than in the supply mode.

25. An image forming apparatus as claimed in claim 23, wherein the removing member is disposed adjacent the supply station.

26. An image forming apparatus as claimed in claim 15, wherein the supply station includes a container for containing the liquid material, and the liquid material holding member is disposed such that a portion thereof is immersed in the liquid material contained in the container.

27. An image forming apparatus as claimed in claim 15, wherein the liquid material holding member comprises a roller.

28. An image forming apparatus as claimed in claim 15, wherein the removing member comprises a blade.

* * * * *